US009765418B2

(12) United States Patent
Mašek et al.

(10) Patent No.: US 9,765,418 B2
(45) Date of Patent: Sep. 19, 2017

(54) MICROSTRUCTURE OF HIGH-ALLOY STEEL AND A HEAT TREATMENT METHOD OF PRODUCING THE SAME

(71) Applicant: Západočeská univerzita v Plzni, Plzeň (CZ)

(72) Inventors: Bohuslav Mašek, Kaznějov (CZ); Hana Jirková, Plzeň (CZ); David Aišman, Plzeň (CZ); Filip Vančura, Zlín (CZ)

(73) Assignee: ZÁPADOCESKÁ UNIVERZITA V PLZNI, Plzen (CZ)

( * ) Notice: Subject to any disclaimer, the term of this patent is extended or adjusted under 35 U.S.C. 154(b) by 110 days.

(21) Appl. No.: 14/716,618

(22) Filed: May 19, 2015

(65) Prior Publication Data

US 2015/0337417 A1 Nov. 26, 2015

(30) Foreign Application Priority Data

May 21, 2014 (CZ) ..... 2014-348

(51) Int. Cl.

| | |
|---|---|
| ***C22C 38/24*** | (2006.01) |
| ***C22C 38/04*** | (2006.01) |
| ***C21D 6/00*** | (2006.01) |
| ***C21D 7/13*** | (2006.01) |
| ***C22C 38/02*** | (2006.01) |
| ***C22C 38/22*** | (2006.01) |
| ***C22C 38/36*** | (2006.01) |
| ***C22C 33/02*** | (2006.01) |
| *B21J 5/00* | (2006.01) |

(52) U.S. Cl.

CPC ..... *C22C 38/24* (2013.01); *C21D 6/002* (2013.01); *C21D 6/005* (2013.01); *C21D 6/008* (2013.01); *C21D 7/13* (2013.01); *C22C 33/0285* (2013.01); *C22C 38/02* (2013.01); *C22C 38/04* (2013.01); *C22C 38/22* (2013.01); *C22C 38/36* (2013.01); *B21J 5/004* (2013.01); *B22F 2998/10* (2013.01); *B22F 2999/00* (2013.01); *C21D 2211/004* (2013.01); *C21D 2211/008* (2013.01)

(58) Field of Classification Search

CPC ..... C21D 2211/001; C21D 2211/008; C21D 2211/003; C21D 2211/004; C21D 7/13; C21D 6/002; C21D 6/005; C21D 6/008; C22C 38/24; C22C 38/22; C22C 38/04

See application file for complete search history.

*Primary Examiner* — Jessee Roe

(74) *Attorney, Agent, or Firm* — Hovey Williams LLP

(57) ABSTRACT

A method of producing a microstructure of a high-alloy steel includes heating the metal stock to a temperature between 1270° C. and 1280° C., at a rate between 40° C./s and 45° C./s, followed by compression applied to the metal stock in a thixotropic process, after which the stock is cooled to ambient temperature. A microstructure is also shown, which includes undissolved metal carbides in the form of globular particles of austenite microstructure and of martensite microstructure.

3 Claims, 2 Drawing Sheets

MICROSTRUCTURE OF HIGH-ALLOY STEEL AND A HEAT TREATMENT METHOD OF PRODUCING THE SAME

RELATED APPLICATION

This application claims the benefit of Czech Republic Application No. PV2014-348 filed May 21, 2014, the entire disclosure of which is incorporated herein by reference.

FIELD OF THE INVENTION

The present invention relates to a microstructure of a high-alloy steel in so small parts and a heat treatment method of producing such microstructure.

PRIOR ART

In literature, the term high-alloy steels is used for steels which contain alloying elements at a total level of more than 10%. By means of alloying elements, the required mechanical, physical and chemical properties are achieved. Properties of such steels depend not only on chemical composition but mainly on microstructure, i.e. on the phase composition and on the shape and configuration of individual phases. The desired microstructure in steels with suitable chemical compositions is achieved by means of heat treatment. Heat treatment includes all procedures, by which the internal structure of metal is intentionally changed by varying the temperature.

In the course of heat treatment, microstructure changes may occur in two ways: if the microstructure is in a non-equilibrium state, processes which lead to thermodynamic equilibrium represented by the Fe—$Fe_3C$ diagram can be used. These processes are collectively termed annealing. During this type of processing, ferrite, ferrite-pearlite or ledeburite microstructure may form, depending on the carbon content. The other group of processes involves creating non-equilibrium microstructures which form upon rapid cooling. By this means, martensite and bainite microstructures with high strength but low toughness are created. These processes are termed quenching. For instance, there is another heat treatment which is termed thixoforming. The suitability of steels for thixoforming is given by a number of criteria. Those are typically described by technological parameters which document the steels' behaviour during semi-solid processing. Of those, most attention is typically paid to the interval between solidus and liquidus temperatures, as today's technology has not been capable of controlling temperature of the material processed with required precision and small enough temperature variations. The wider the interval between the solidus and liquidus, the more uniform properties can be obtained throughout the material. This interval is typically reported to depend primarily on the chemical composition of the material. It can be altered, to some extent, by the heating method and heating rate and, in some cases, by the structure of the initial material. Almost no information on the correlation with the initial microstructure is available in the literature. However, the suitability of steels for semi-solid processing is not given by the sole absolute temperature interval between the solidus and liquidus but mainly by the curve which describes the ratio between the solid phase and the liquid phase vs. temperature during the melting process. However, it can strongly depend on the microstructure and local chemical composition. As for the microstructural condition and, in particular, the preparation of the steel stock for thixoforming by other than conventional methods, information in literature is only found in rare cases.

PRINCIPLES OF EMBODIMENT

The present invention relates to a microstructure of high-alloy steel and a heat treatment method of producing the same. The processing of such steel leads to a special microstructure which consists of undissolved metal carbides in the form of globular particles, austenite and martensite microstructure.

The method of achieving a microstructure of high-alloy steel by cross extrusion consists of the following procedure: the metal stock is heated to a temperature between 1270° C. and 1280° C. at a rate between 40° C./s and 45° C./s, and then compression is applied to the metal stock in a thixotropic process, after which the stock cools to ambient temperature.

EXAMPLE EMBODIMENT

The steel chosen for the experimental example has a chemical composition which is compatible with the proposed processing strategy and enables its implementation. Based on calculations, the CPM 15V steel made by powder metallurgy was chosen. In its basic condition, it consists of vanadium and chromium carbides embedded in a ferritic matrix. This steel possesses high wear resistance and high hardness. Its great weaknesses consist in poor formability and machinability.

TABLE 1

Chemical composition of CPM 15V steel (wt. %)

| C | Cr | V | Mo | Mn | Si |
|---|---|---|---|---|---|
| 3.40 | 5.25 | 14.5 | 1.30 | 0.50 | 0.90 |

In order to gain more complete understanding of the mechanical properties, a compression test was used, thanks to which the load response of the material can be determined.

Figure 1:
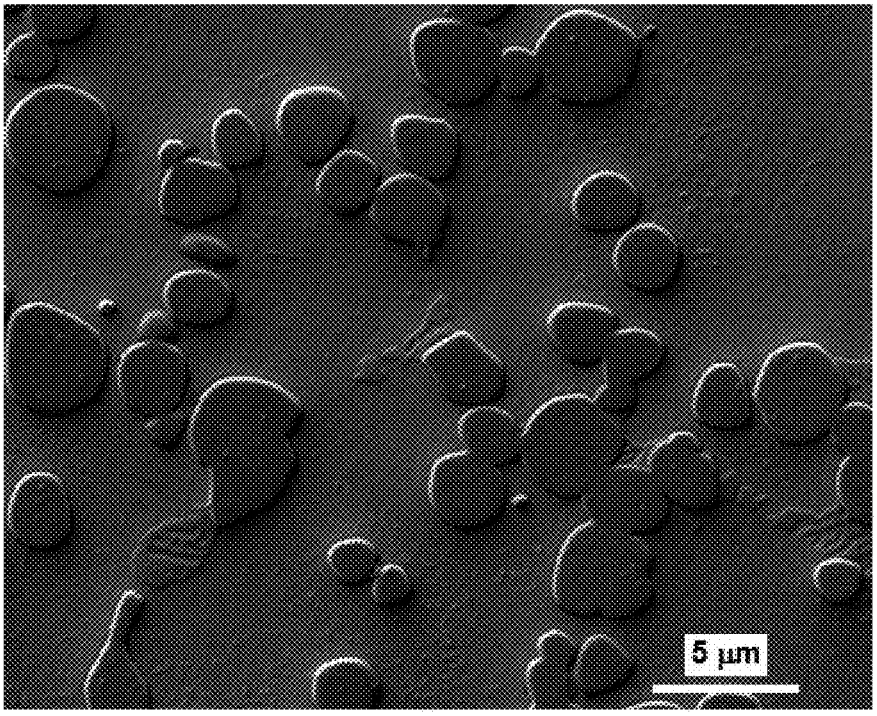
FIG. 1 and FIG. 2 show the resulting microstructure using an optical microscope and FIG. 3 shows the resulting microstructure using a scanning microscope.
Figure 2:
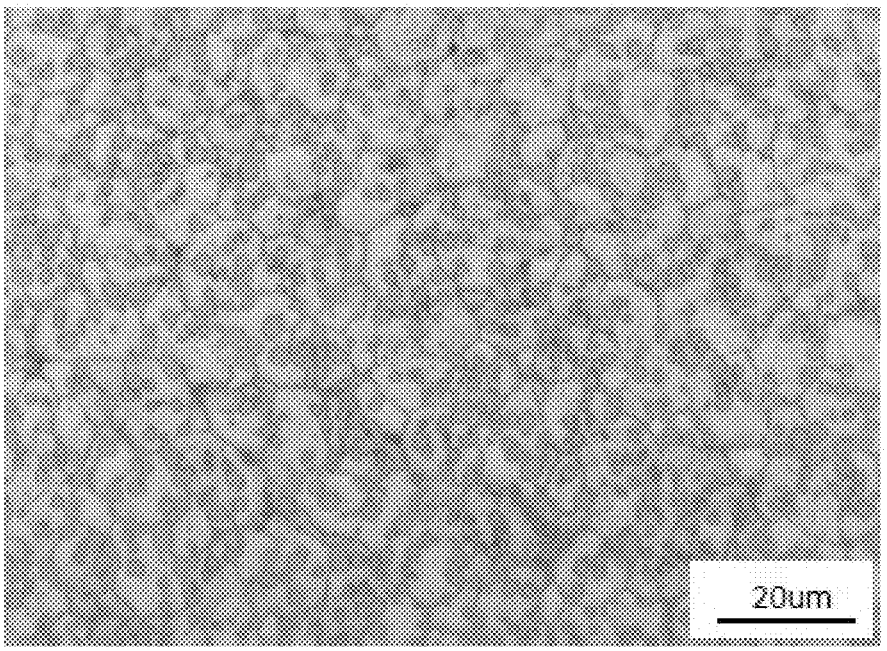
Figure 3:
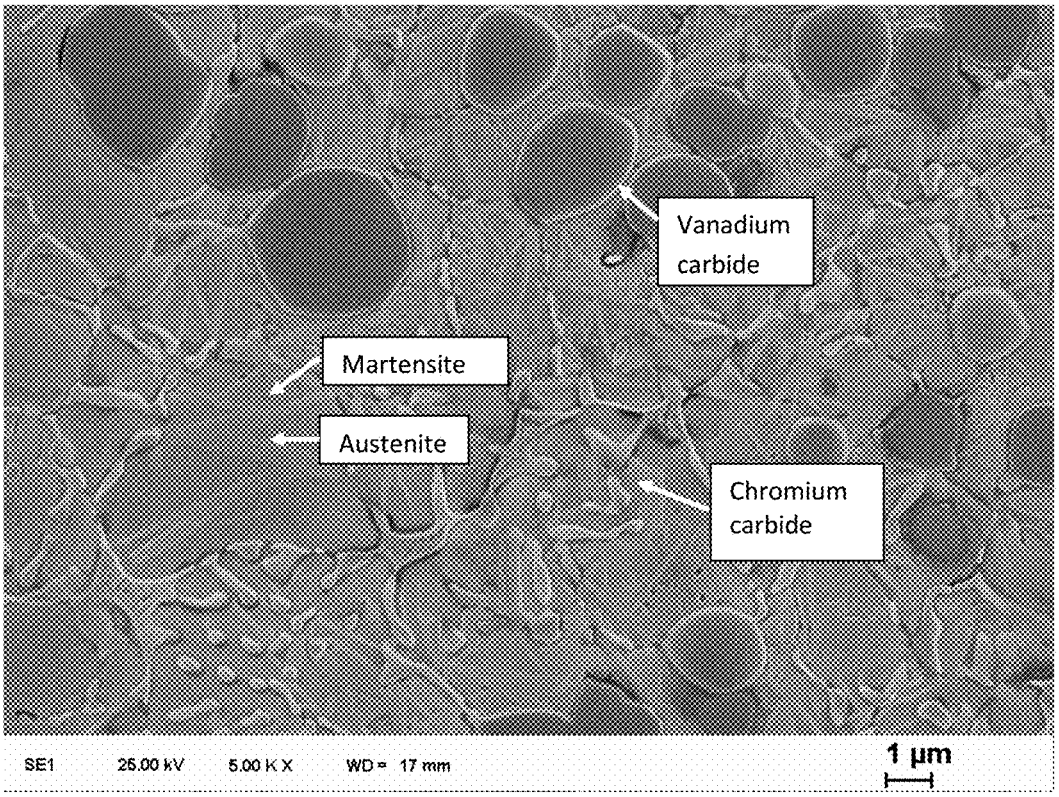

In the initial condition, the average measured hardness was 298 HV10. In the thixoformed condition, the hardness was 728 HV10. The same trend was observed in the compression test, where the yield strength upon semi-solid forming increased from the initial value of 627 MPa to 1990 MPa, which represents a threefold increase. This notable increase in compressive yield strength can be attributed mainly to the martensite in the matrix and to the precipitation of chromium in the form of network. The microstructure of the material upon thixoforming consisted of globular vanadium carbides embedded in an austenitic matrix, as shown in FIG. 1 and FIG. 2. X-ray diffraction phase analysis showed that the microstructure of the CPM 15V steel in the centre of the product upon thixoforming at 1270° C. was a mixture of austenite 50%, an iron phase with a body-centred cubic crystal structure 29% and V8C7 vanadium carbides 21%. In the case of the alpha-iron phase, it is martensite. The comparison with the initial condition of the CPM 15V steel revealed that the V8C7 carbides remained present in the microstructure and that the ferritic matrix transformed to austenite and martensite. The occurrence of those carbides in the microstructure provides the products with new potential, e.g. for high wear resistance. Vickers hardness was measured along the entire length of the product.

TABLE 2

Comparison between compressive yield strength and Vickers hardness parameters

| | Compressive yield strength [MPa] | | HV10 [—] | |
|---|---|---|---|---|
| | Initial condition | Thixoformed condition | Initial condition | Thixoformed condition |
| CPM 15V | 627 | 1990 | 298 | 728 |

The invention claimed is:

1. Microstructure of a high-alloy steel characterized by its content of undissolved metal carbides in the form of globular particles in the range of 10 wt. %-25 wt. %, 40 wt. %-50 wt. % austenite microstructure and 10 wt. %-25 wt. % martensite microstructure.

2. A method of producing the microstructure of a high-alloy steel in claim 1 characterized by heating the metal stock to a temperature between 1270° C. and 1280° C. at a rate between 40° C./s and 45° C./s, after which compression is applied to the metal stock in a thixotropic process, after which the stock cools to ambient temperature.

3. A method of producing the microstructure of a high-alloy steel in claim 2 characterized by the use of thixoforming after heating to a temperature between 1270° C. and 1280° C.

* * * * *